United States Patent [19]

Bruning et al.

[11] Patent Number: 4,784,635

[45] Date of Patent: Nov. 15, 1988

[54] CONTINUOUS-OPERATION CENTRIFUGE DRUM FOR CONCENTRATING SUSPENDED SOLIDS

[75] Inventors: Paul Bruning; Wilfried Mackel, both of Oelde; Ulrich Wrede, Ennigerloh-Ostenfelde, all of Fed. Rep. of Germany

[73] Assignee: Westfalia Separator AG, Oelde, Fed. Rep. of Germany

[21] Appl. No.: 39,210

[22] Filed: Apr. 16, 1987

[30] Foreign Application Priority Data

Apr. 19, 1986 [DE] Fed. Rep. of Germany ..... 3613335
Oct. 15, 1986 [DE] Fed. Rep. of Germany ..... 3635059

[51] Int. Cl.[4] ..... B04B 11/02

[52] U.S. Cl. ..... 494/70; 494/67; 494/74

[58] Field of Search ..... 494/27, 29, 30, 34, 494/43, 44, 64, 70–72, 67–69, 76, 73, 85; 210/371, 380.1, 360.1, 374, 377, 781

[56] References Cited

U.S. PATENT DOCUMENTS 3,117,928 1/1964 Thylefors ..... 494/71 X
3,468,475 9/1969 Thylefors ..... 494/70
4,193,537 3/1980 Bodelson et al. ..... 494/70
4,614,598 9/1986 Zettier ..... 210/781
4,631,049 12/1986 Zettier ..... 494/71
4,695,270 9/1987 Zettier ..... 494/34

*Primary Examiner*—Timothy F. Simone
*Attorney, Agent, or Firm*—Sprung Horn Kramer & Woods

[57] ABSTRACT

In the continuous-operation centrifuge drum for concentrating suspended solids the solids are conveyed to a central chamber from a solids space through channels. Before the solids arrive in the central chamber, they must travel through an unribbed annular space. Since the solids concentrate tends to increase its existing kinetic energy, a higher flow resistance is generated. As viscosity increases, the solids, however, are more powerfully affected by friction in the unribbed annular space, their kinetic energy decreases, and the flow resistance decreases. The resulting increase in the volume of solids extracted also decreases its concentration and hence its viscosity. This behavior of the solids in the unribbed annular space of a rotating drum results in automatic regulation of the solids concentration.

17 Claims, 3 Drawing Sheets

CONTINUOUS-OPERATION CENTRIFUGE DRUM FOR CONCENTRATING SUSPENDED SOLIDS

BACKGROUND OF THE INVENTION

The present invention relates to a continuous-operation centrifuge drum for concentrating suspended solids, wherein the concentrated solids are conveyed through channels from a solids space in the outer region of the drum into a chamber toward the center of the drum, from which the concentrated solids are continuously extracted.

A centrifuge drum of this type is known, for example from German Pat. No. 2 701 624. The amount of solids extracted from the drum is regulated by varying the flow cross-section of the channels by means of valves provided with flexible-tube diaphragms and positioned therein. Since, however, diaphragms of this type are sensitive to abrasive solids, they cannot be employed in many applications. If the valves are exploited to regulate the concentration of the extracted solids, the controls technology involved will be relatively expensive because the viscosity of the extracted solids must be measured and a proportional fluid pressure exerted on the diaphragms from outside.

SUMMARY OF THE INVENTION

The object of the present invention is to provide a centrifuge drum for concentrating suspended solids wherein the amount of extracted solids can be automatically regulated in the drum as a function of viscosity.

This object is attained in accordance with the invention by the improvement wherein at least one unribbed annular space with an outer surface and an inner surface is positioned between the inner chamber and the channels in such a way that the solids must travel through it from one surface to the other.

The peripheral velocity prevailing at any diameter of the unribbed annular space is not imposed on the liquids that flow through it from one surface to the other. The liquids, rather, will assume higher peripheral velocities as their kinetic energy increases. This tendency opposes only the fluid friction present in unribbed annular spaces. Since fluid friction increases with the viscosity of the liquid, the kinetic energy of a highly viscous liquid will change to a greater extent than that of a low-viscosity liquid. The consequence of this principle is that a low-viscosity liquid will generate a higher resistance as it flows through an unribbed annular space than a highly viscous liquid will. Thus, the resistance generated as a result of the unribbed annular space will decrease as the viscosity of the concentrated solids increases, and, given constant initial conditions, the flowthrough volume will also increase. Increasing the flowthrough volume, however, will then decrease the viscosity of the concentrated solids, resulting in the desired automatic regulation of solids concentration.

The drum can be designed with the unribbed annular space connected at its inner surface to the central chamber and the channels opening into the annular space at its outer surface. The concentrated solids will accordingly flow through the rotating unribbed annular space from outside in, migrating from a point of higher peripheral velocity to one of lower peripheral velocity in the drum and tending to increase their peripheral velocity. The result will be a fluid pressure higher than that in similar but ribbed spaces, in which the liquid assumes the peripheral velocity of the drum at every point. The unribbed annular space can be dimensioned such that, at a given total channel cross-section, only a prescribed volume of solids will flow through them. Thus, if the concentration of the solids increases for example because the level of solids in the arriving product has increased, the viscosity of the solids derived from the drum will also increase. The increased viscosity, however, will also increase the entrainment of concentrated solids along the walls of the unribbed annular space, and the peripheral velocity of the concentrated solids along its radially inward course will be drastically decreased, so that the fluid pressure at the exit from the channels will be considerably lower. The available difference between the pressures at the entrance into the channels in the solids space and the outlets from the channels in the unribbed annular space will accordingly increase along with the volume of solids extracted. This will result in simultaneous decreases in both the concentration and hence the viscosity of the solids, so that the entrainment in the unribbed annular space will be reduced again and the fluid pressure increased again.

The drum can however also be designed with the unribbed annular space connected at its outer surface to the central chamber and channels opening into the annular space at its inner surface. The pressure exerted on the outer surface of the unribbed annular space in this embodiment will be higher, the higher the peripheral velocity of the solids at this point is. Since highly viscous concentrate will, as it travels from a shorter diameter to a longer diameter in the unribbed annular space, be more powerfully accelerated than a low-viscosity concentrate, the available pressure will also be higher. Thus, the flow through the unribbed annular space will increase with viscosity, as will the aforesaid automatic regulation.

At least one other unribbed annular space can in one practical embodiment of the invention be positioned downstream of the the first unribbed annular space, with both spaces communicating in such a way that the solids will have to travel through them in sequence on the way to the central chamber, traveling from the outside in through one of the spaces and from the inside out through the other. The desired effect can be increased to any desired extent by using several communicating annular spaces with their inner and outer surfaces at given diameters.

Their function can be optimized by providing ribs at the conjunctions between the unribbed annular spaces to accelerate the solids to the peripheral velocity prevailing at those points.

To establish the basal volume of solids to be extracted it is practical for the unribbed annular spaces to extend far enough out radially to ensure that the desired volume of solids will be extracted from he drum at a given overall cross-section on the part of the channels.

The volume of solids extracted, however, can also be established if the channels open into the unribbed annular space in such a way that the solids will only have to travel through part of the space.

Another means of varying the volume of solids to be extracted is to position a ribbed annular space radially outward from and upstream of the unribbed annular space with the channels opening into the ribbed upstream space.

At a given inside diameter of the unribbed annular space and with the channels opening into the ribbed space along a given limb, the farther the ribbed space extends radially outward, the less the unribbed space will extend radially outward. Thus the pressure drop generated by the unribbed space will decrease and the volume of solids extracted will increase even though the path that the solids must travel from the channels to the inside diameter of the unribbed annular space does not change.

The basal volume of the extracted solids can be simply established in accordance with the aforesaid potentials if the unribbed annular spaces can be varied by replacing an insert.

The height H of the unribbed annular spaces can in a practical way be low enough for the resulting flow velocity to prevent solids from precipitating in the spaces.

Constrictions can be associated with the channels. The constrictions can be located in the channels. The constrictions can be located in the insert.

A pressure-regulation valve can be positioned in the outflow line for the clarified phase.

The constrictions can open tangentially into the unribbed annular space. Orienting the exits from the channels tangentially will add the velocity of the solids flowing into the channels to the peripheral velocity of the drum where the solids are fed into the unribbed annular space. Thus, greater differences between the peripheral velocity of the solids at the infeed into the annular space and the peripheral velocity of the annular space at the point where the solids exit will be available for varying the kinetic energy of the solids.

If the channels open into the annular space at its inner surface, the exits from the channels should face opposite the direction in which the drum rotates. In terms of the peripheral velocity of the annular space at this point, the peripheral velocity of the solids will be decreased by the velocity at which they flow into the exits. On the way to the outer surface of the annular space, the solids can be accelerated to no more than the peripheral velocity prevailing at that point. Any difference between these velocities will accordingly have increased, due to the proposed method of feeding the solids in, along with the potential range for regulating in accordance with viscosity the volume of solids flowing through the annular space.

If the channels are located at the outer surface of the annular space, the exits from the channels should face parallel to the direction in which the drum rotates so that the solids can start from a higher peripheral velocity as they flow through the annular space toward its inner surface.

Some preferred embodiments of the invention will now be specified with reference to the attached drawings, wherein

DETAILED DESCRIPTION OF THE PREFERRED EMBODIMENTS

Figure 1:
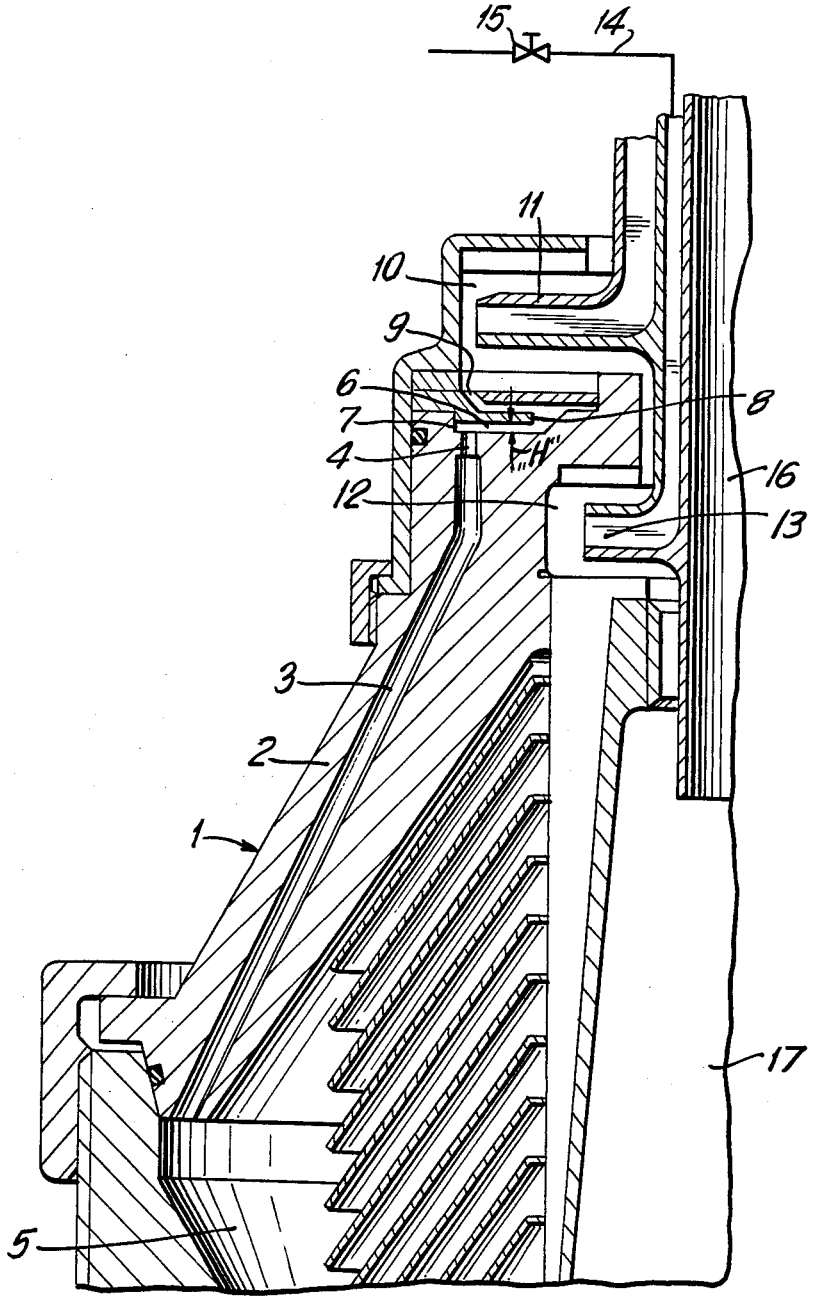
FIG. 1 is a partial section through the drum according to the invention.

Channels 3, with constrictions 4, extend through the lid 2 of the centrifuge drum 1 illustrated in FIG. 1. Channels 3 extend from a solids space 5 and open into an unribbed annular space 6 at its outer surface 7. Unribbed annular space 6 communicates at its inner surface 8 with a central chamber 10 through an annular gap 9. A skimmer 11 is accommodated in central chamber 10. Another skimmer 13, accommodated in a chamber 12, leads to an outflow line 14. A pressure-regulation valve 15 is positioned in line 14. A product feed 16 opens into an intake chamber 17.

The centrifugate conveyed through product feed 16 is clarified in drum 1, and the precipitated solids are collected in solids space 5, whence they are conveyed into unribbed annular space 6 through channels 3 and constrictions 4. As long as the solids concentrate is fluid, it will increase its peripheral velocity as accelerated at constrictions 4 as it travels radially in through unribbed annular space 6, generating a relatively high flow resistance in the space. Thus the cross-section of constrictions 4 can be relatively large, and the constrictions can even be eliminated, in which case the basal volume of the diverted solids will be established by the inside diameter of unribbed annular space 6. As the viscosity of the solids increases, the increased friction on the walls of the unribbed annular space 6 will impose the inwardly decreasing peripheral speed on the solids, whereupon the fluid pressure at constrictions 4 will be decreased and the volume of solids diverted will be increased. This leads again to a decrease in the concentration of solids and hence in viscosity. As the viscosity of the solids increases, the volume diverted will automatically increase, whereas, as the viscosity decreases, the volume diverted will automatically decrease. This corresponds to the known regulating behavior of conventional controls positioned outside the drum.

Figure 2:
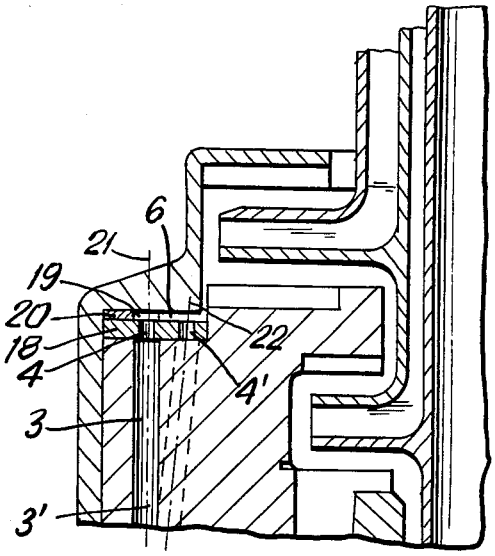
FIG. 2 illustrates the unribbed annular space positioned in the insert.

FIG. 2 shows unribbed annular space 6 mounted in a replaceable insert 18, making it possible to adapt the drum to various conditions more rapidly. At constant diameters the radial extension of unribbed annular space 6 can easily be varied, if another annular space 20 provided with ribs 19 is positioned upstream, by rotating the ribs backward for example. Constrictions 4 and 4' can also be oriented in insert 18 along different limbs 21 and 22, to which different channels 3 and 3' lead, and the insert can be rotated to align either the constrictions 4 on outer limb 21 or the constrictions 4' on inner limb 22 with their associated channels 3 and 3', releasing them for extracting the solids through.

Figure 3:
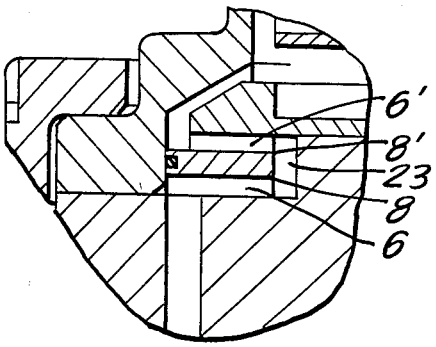
FIG. 3 illustrates a drum with two communicating unribbed annular spaces.

FIG. 3 shows a drum with two communicating unribbed annular spaces 6 and 6'. Ribs 23 are provided at the conjunction between the two spaces, which simultaneously constitutes their inner surface 8 and 8'. Ribs 23 initially return the solids to the peripheral velocity prevailing at the conjunction as they are diverted from annular space 6 to annular space 6'.

Figure 5:
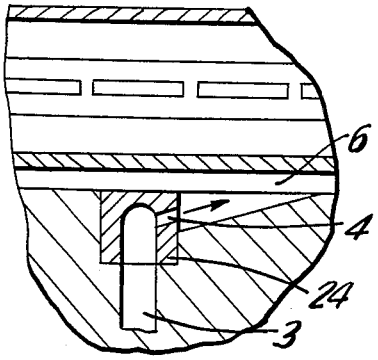
FIG. 5 is a section along the line II—II in FIG. 4.
Figure 4:
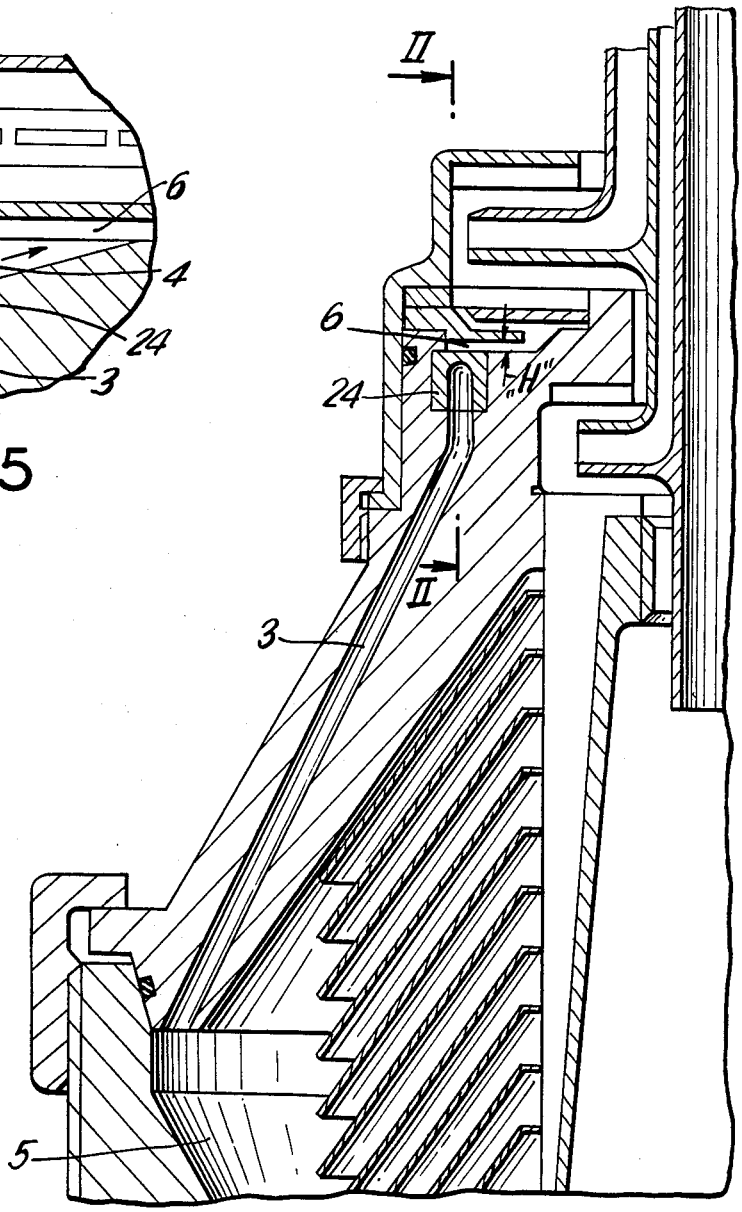
FIG. 4 illustrates a drum according to the invention with constrictions opening tangentially into the the unribbed annular space.

The constrictions 4 illustrated in FIG. 4, which are located in insert components 24, empty tangentially, in relation to the direction in which the drum turns, into unribbed annular space 6 (FIG. 5). The precipitated solids are conveyed into unribbed annular space 6 through channels 3 and constrictions 4. The tangential orientation of constrictions 4 along the direction that the drum rotates in adds the flow velocity of the solids to the peripheral velocity of unribbed annular space 6 at this point.

It will be appreciated that the instant specification and claims are set forth by way of illustration and not limitation, and that various modifications and changes may be made without departing from the spirit and scope of the present invention.

What is claimed is:

1. In a continuous-operation centrifuge drum for concentrating suspended solids and having a radially outer portion, central portion and inner portion, including means forming a solid space in the radially outer portion of the drum, means forming an extraction chamber toward the radially central portion of the drum, from which the concentrated solids are continuously extracted, and means forming channels between the solids space and extraction chamber and through which concentrated solids are conveyed, the improvement comprising means forming at least one unribbed annular space with a radially outer surface and a radially inner surface and positioned between the extraction chamber and the channels to effect the travel of solids through the unribbed annular space from one of the inner and outer surfaces to the other.

2. The drum as in claim 1, wherein the at least one unribbed annular space is connected at its inner surface to the extraction chamber and the channels open into the annular space at its outer surface.

3. The drum as in claim 1, wherein the at least one unribbed annular space is connected at its outer surface to the extraction chamber and the channels open into the annular space at its inner surface.

4. The drum as in claim 1, further comprising at least one other unribbed annular space positioned downstream of the the first mentioned at least one unribbed annular space, with both unribbed spaces communicating such that the solids will travel through them in sequence on the way to the extraction chamber, traveling from the outside in through one of the unribbed spaces and from the inside out through the other the unribbed spaces.

5. The drum as in claim 4, wherein ribs are provided at junctions between the unribbed annular spaces.

6. The drum as in claim 1, wherein the unribbed annular spaces extend sufficiently radially outwardly to ensure that the desired volume of solids will be extracted from the drum for a given overall cross-section of the channels.

7. The drum as in claim 1, wherein the channels open into the unribbed annular space in such that the solids only travel through part of the unribbed space.

8. The drum as in claim 1, further comprising means forming a ribbed annular space is positioned radially outwardly from and upstream of the at least one unribbed annular space with the channels opening into the ribbed upstream space.

9. The drum as in claim 1, wherein the means forming at least one unribbed annular space includes a removable insert for adjusting the radial extent of the unribbed space.

10. The rum as in claim 1, wherein the height of the at least one unribbed annular spaces is sufficiently low for the resulting flow velocity to prevent solids from precipitating in the unribbed spaces.

11. The drum as in claim 1, further comprising means forming constriction associated with the channels.

12. The drum as in claim 11, wherein the constrictions are located in the channels.

13. The drum as in claim 9, further comprising means forming constrictions in the insert and associated with the channels.

14. The drum as in claim 1, further comprising a pressure-regulation valve positioned in an outflow line for clarified phase.

15. The drum as in one of claim 1, wherein the constriction open tangentially into the at least one unribbed annular space.

16. The drum as in claim 15, wherein the constrictions face opposite the direction of rotation of the drum and open into the at least one unribbed annular spaces at the inner surface.

17. The drum as in claim 15, wherein the constrictions face along the direction of rotation of the drum and open into the at least one unribbed annular spaces at the outer surface.

* * * * *

UNITED STATES PATENT AND TRADEMARK OFFICE

CERTIFICATE OF CORRECTION

PATENT NO. : 4,784,635

DATED : Nov. 15, 1988

INVENTOR(S) : Bruning et al.

It is certified that error appears in the above-identified patent and that said Letters Patent is hereby corrected as shown below:

| | |
|---|---|
| Col. 2, line 39 | Delete "the" in second instance |
| Col. 6, line 18 | Delete "rum" and substitute --drum-- |

Signed and Sealed this

Twenty-sixth Day of December, 1989

*Attest:*

JEFFREY M. SAMUELS

*Attesting Officer* *Acting Commissioner of Patents and Trademarks*